United States Patent [19]

Hovinga

[11] Patent Number: 4,679,715

[45] Date of Patent: Jul. 14, 1987

[54] ICE CUBE DISPENSING OUTLET

[75] Inventor: Donald G. Hovinga, Mason City, Iowa

[73] Assignee: Schneider Metal Manufacturing Co., Mason City, Iowa

[21] Appl. No.: 773,479

[22] Filed: Sep. 6, 1985

[51] Int. Cl.[4] ..... B67D 3/00; B67D 5/62

[52] U.S. Cl. ..... 222/517; 141/362; 222/146.6; 222/556; 62/344

[58] Field of Search ..... 222/146.6, 505, 508, 222/516, 517, 556, 558, 560; 62/344, 265, 266; 141/351, 360–362; 49/386

[56] References Cited

U.S. PATENT DOCUMENTS

| | | | |
|---|---|---|---|
| 3,537,273 | 11/1970 | Alvarez | 62/344 X |
| 3,885,711 | 5/1975 | Martindale | 222/146.1 |
| 3,916,949 | 11/1975 | Armstrong | 222/556 X |
| 4,069,545 | 1/1978 | Holet et al. | 141/362 X |
| 4,090,641 | 5/1978 | Lindenschmidt | 222/556 X |
| 4,209,999 | 7/1980 | Falk et al. | 141/362 X |

FOREIGN PATENT DOCUMENTS

| | | | |
|---|---|---|---|
| 344947 | 4/1960 | Switzerland | 141/362 |

*Primary Examiner*—Joseph J. Rolla
*Assistant Examiner*—Kevin P. Shaver
*Attorney, Agent, or Firm*—Henry C. Kovar

[57] ABSTRACT

An ice cube and cold beverage dispenser has a cabinet with a single inside bin chamber for ice cubes. A cold plate beverage chiller is located in the bottom of the chamber. A ice cube agitator and outlet is spaced above the cold plate. A false bottom is located under the agitator and outlet with the false bottom being spaced above the cold plate and having cube ports for passing cubes downward upon the plate and for precluding dispensing of cubes dropped on the plate, with front and rear walls and the agitator and the cold plate and the false bottom all being canted forward. The agitator is of lesser diameter than the width of the cube bin and is located on one side of the bin and a feeder driven by the agitator in an opposite direction of rotation feeds ice cubes upwards and towards the center. An improved ice cube dispensing outlet and control has a chute, a segment shaped normally closed door, a manual door opener mechanically connected to the door, and a dispenser actuator switch which is operated by the arcuate surface of the door when the door is open.

5 Claims, 5 Drawing Figures

ICE CUBE DISPENSING OUTLET

BACKGROUND OF THE INVENTION

1. Field of the Invention

This invention pertains to a dispenser for ice cubes and cold beverage having a cold plate beverage cooler, to an ice cube dispenser, and to a dispensing chute and control apparatus for an ice cube dispenser.

2. The Prior Art

There is an emerging market need for combination ice cube and cold beverage dispensers which are in a single cabinet. A cold plate is at the bottom of the cabinet and ice cubes in the cabinet are used firstly to cool the cold plate and secondly they are dispensed into the beverage cup before the drink is dispensed.

A specific examples of this is C. M. Lents U.S. Pat. No. 4,423,830.

There is an emerging body of opinion that prefers to not take ice cubes off of the cold plate for several reasons. These ice cubes are partially melted, may carry excessive metal content from the cold plate, and are excessively wet because of the constant high melt down needed to cool beverage.

OBJECTS OF THE INVENTION

It is an object of the present invention to provide a combination ice cube and cold beverage dispenser having a cold plate and which dispenses ice cubes from well above the cold plate so that cubes on the cold plate are not dispensed.

It is an object of the present invention to provide an ice cube dispenser having a relatively small agitator off to one side of the ice cube bin so that a relatively small and lesser cost motor and gear box can be used, together with a feeder to bring ice cubes to the center of the dispenser.

It is an object of the present invention to provide an improved ice dispensing chute and control having a segment shaped door and a dispenser switch actuated by an arcuate surface of the door.

These and other objects of the invention will become manifest to those versed in the art upon review of the teachings herein.

SUMMARY OF THE INVENTION

According to the principles of the present invention, an ice cube and cold drink dispenser has an insulated cabinet with a single ice cube chamber, a cold plate in a bottom of the chamber, an ice cube agitator and cube outlet spaced above the cold plate, a discrete false bottom under the agitator and spaced up above the cold plate, and structure in the false bottom for passing ice cubes to the cold plate and for precluding ice cubes passed to the cold plate from being dispensed.

An ice cube dispenser has a cabinet, a cube agitator having a diameter significantly less than a width of the cabinet, a rotatable cube feeder in front of the agitator, and a dispensing outlet adjacent to the transverse centerline of the dispenser, the dispensing outlet is supplied by the cube feeder.

An improved ice cube dispensing outlet and control has a chute, a segment shaped normally closed outlet door, a manual door opener, structure connecting the opener to the door, a spring biasing the door closed, an ice dispensing switch, and structure on the arcuate outer surface of the door for operating the switch.

DESCRIPTION OF THE PREFERRED EMBODIMENT

Figure 1:
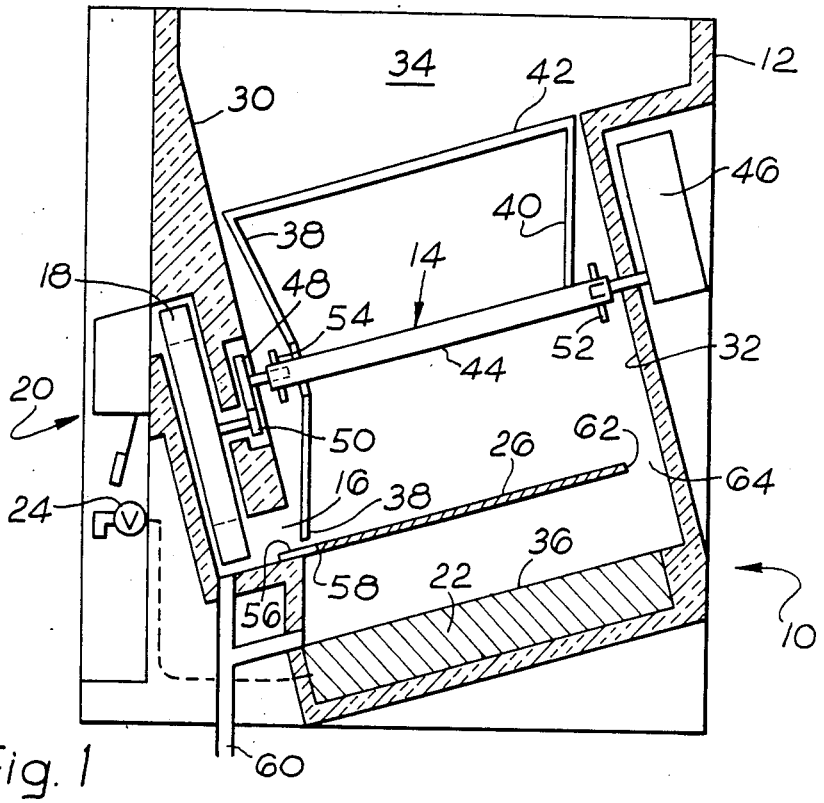
FIG. 1 is an elevational cross-sectioned side view of the preferred embodiment of an ice cube and cold drink dispenser according to the present invention.

According to the principles of the present invention, a combination ice dispenser and dispenser for cold beverages is provided as is shown in FIG. 1 and is generally indicated by the numeral 10. The dispenser 10 has an insulated cabinet 12, a cube agitator 14, a cube outlet 16, a cube feeder 18, a dispensing chute and control 20, a cold plate 22 for chilling beverage, dispensing valves 24 which are shown schematically, and a false bottom 26.

Figure 2:
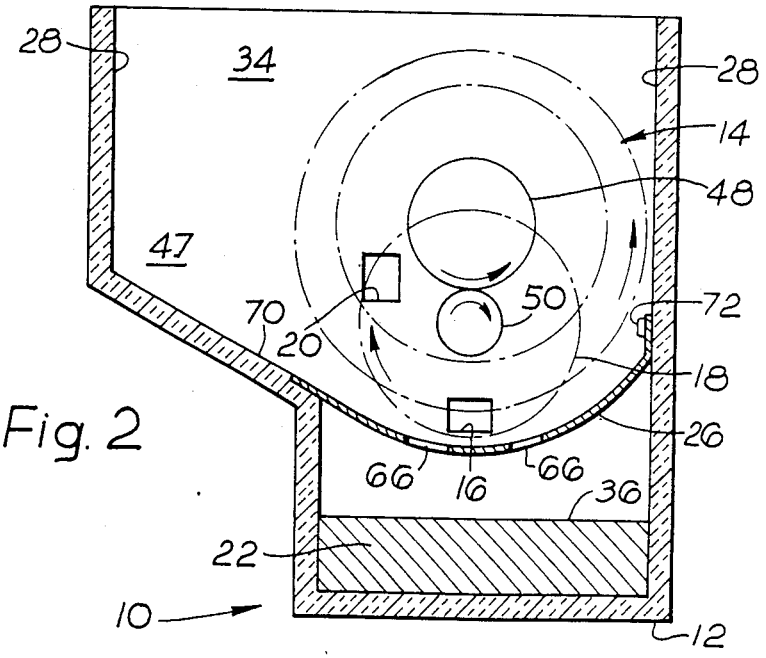
FIG. 2 is an elevational cross-sectioned front view of the structure of FIG. 1.
Figure 3:
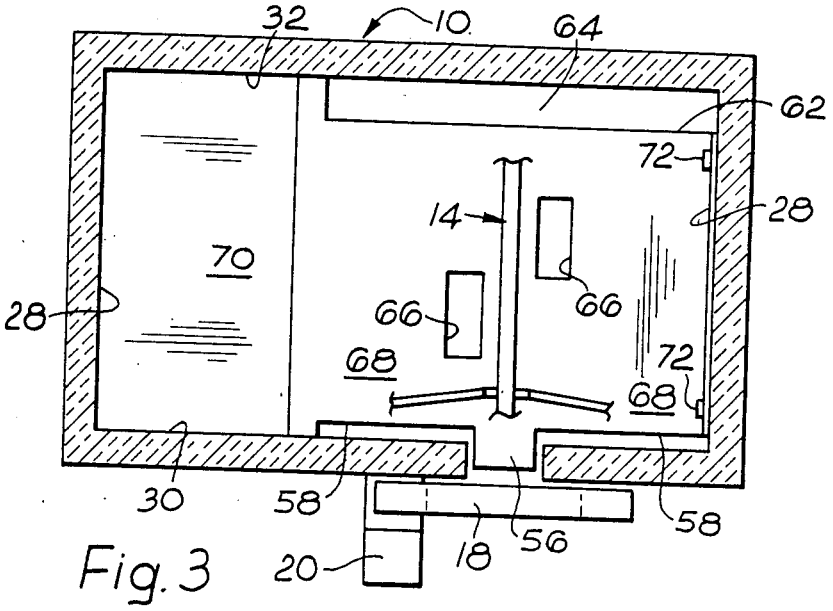
FIG. 3 is a top view of the structure of FIG. 1.

The cabinet 12 has a pair of spaced apart side walls 28, and a forward canted front wall 30 and rear wall 32. The cold plate 22 sits atop of an insulated bottom wall. The cabinet walls 28, 30, 32 and cold plate 22 define a single ice cube bin 34 wherein the cold plate 22 is directly accessible from the top of the bin 34 so the top surface 36 of the cold plate 22 can be periodically cleaned and sanitized. The cube outlet 16 from the bin 34 is spaced upward above the cold plate 22 and in the agitator 14. The agitator 14 has four front radial fingers 38 which go by the cube outlet 16, a single rear radial finger 40, a single sweep 42 which goes over the false bottom 26, and a central shaft 44. The agitator drive motor and gear box 46 can be in the back of the dispenser 10 or underneath, whichever works the best. The cube outlet 16 leads into the cube feeder 18 which preferably is a rotary paddlewheel which elevates ice cubes up to the dispensing chute 20. The dispensing chute 20 is preferably located on or adjacent to the transverse centerline of the dispenser 10 and typically three or four beverage dispensing valves 24 will be mounted on each side of the dispensing chute 20. It has been found that a center mounted cube agitator takes excesive power and requres a relatively large gear box and motor, and greatly increases the cost of a dispenser. The agitator 14 is mounted adjacent to the right side wall 28, as best seen in FIG. 2, and the agitator 14 is rotated counter-clockwise so that it exhausts ice cubes on the right side wall 28. On the left side of the agitator 14 is an ice cube reservoir 47 which feeds the agitator 14 as it empties. It has been found that if the agitator 14 is positioned asymmetrically to one side and rotated to exhaust upward on the side wall, the agitator 14 can be made smaller and use a smaller and less powerful motor and gear box. This saves cost and energy and weight. It seems the ice cubes in the reservoir 47 are not stirred up and around until they are needed and herein lies the energy savings. The feeder 18 is rotated to pick up ice cubes from the bin outlet 16 and elevate the cubes up and transversely to the center mounted dispensing chute 20. The feeder 18 preferably has a rotation reversed from the agitator and turns clockwise in FIG. 1. The feeder 18 is driven by the single motor/gear box 46 through the agitator shaft 44. At the rear of the feeder 18 and to the front of the agitator 14 is a drive gear 48 connected to the agitator shaft 44 and a driven gear 50 connected to the feeder 18. The drive gear 48 preferably has a pitch diameter larger than the pitch diameter of the driven gear 50 so that the feeder 18 turns much faster than the agitator 14, for example twice as fast. The agitator 14 is easily removable from the bin 34 and has a first disconnect coupling 52 to the motor/gearbox 46 and a second disconnect coupling 54 to the drive gear 48. Disconnection of the couplings 52, 54 enables removal of the agitator 14.

The false bottom 26 is under the agitator 14 and bin outlet 16 but is spaced quite a ways above the cold plate top surface 36. The false bottom 26 has a funnel 56 which goes into the bin outlet 16 and front edges 58 to each side of the funnel 56 which are spaced rearward of the cabinet front wall 30 so that melt water and very small ice cubes are drained and dropped through to the cold plate 22 and its front located melt water drain 60. This false bottom 26 keeps ice cubes to be dispensed separate as long as possible and keeps these ice cubes of consistent size. The false bottom 26 has a rear edge 62 which is spaced inward from the cabinet rear wall 32 which opens up a gap 64 across the back of the bin 34 to drop ice cubes through onto the cold plate 22. The false bottom 26 has a plurality of spaced apart and staggered ice cube ports 66 which the sweep 42 goes over. The ports 66 also pass and drop ice cubes upon the cold plate 22. Once the ice cubes pass through or past the false bottom 26 they cannot return upward. The false bottom 26 has an imperforate front section 68 that the ports 66 are spaced rearward of. The preferred false bottom 26 is a sheet of stainless steel that rests upon the reservoir floor 70 and hangs with keyholes and pins 72 on the right wall 28. The false bottom 26 could be made of a screen having apertures small enough to pass melt water, but too small to pass ice cubes; for the functional purpose of the false bottom 26 a screen would be imperforate for ice cubes. The false bottom 26 has a large radius which is swung from a loci well above the shaft centerline of the agitator 14 and the closest point of the false bottom 26 to the agitator 14 is directly under the agitator 14 and rearward of the bin outlet 16. The cube ports 66 are to each side of the centerline of the agitator 14. The cabinet front and rear walls 30, 32, the agitator 14, cube outlet 16, feeder 18, cold plate 22 and false bottom 26 are all canted forward as shown in FIG. 1. This assures that when there is a large supply of cubes that the cold plate 22 will be completely covered through the gap 64, and that when there are very few cubes that the cubes will be divided between the cube outlet 16 and the cold plate 22 by the false bottom 26 and the ports 66. Melt water is disposed of very fast and very well and the dispensing ice cubes above the false bottom 26 are kept as dry as possible and water does not gather on the canted false bottom 26 or adjacent to the cube outlet 16. The inside of the bin 34 can be easily cleaned because the agitator 14 and false bottom 26 are both easily removable from the bin 34 giving direct access to the cold plate 22.

Figure 4:
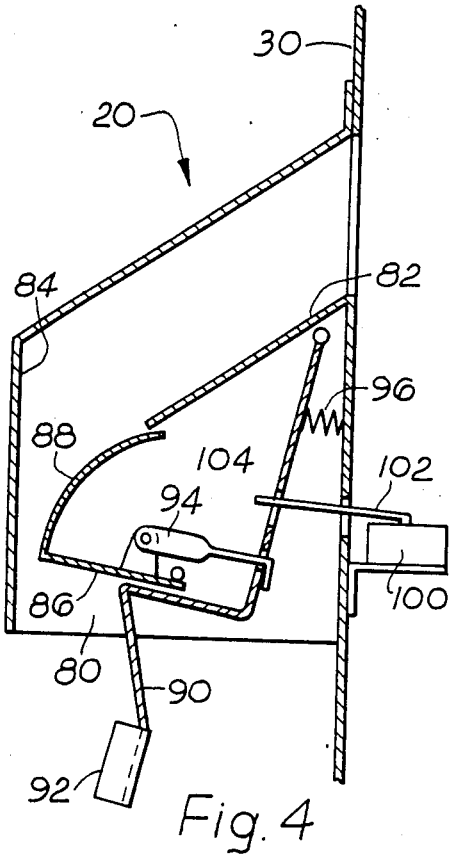
FIG. 4 is an elevational cross-sectioned side view of the dispenser outlet and control on the structure of FIG. 1.
Figure 5:
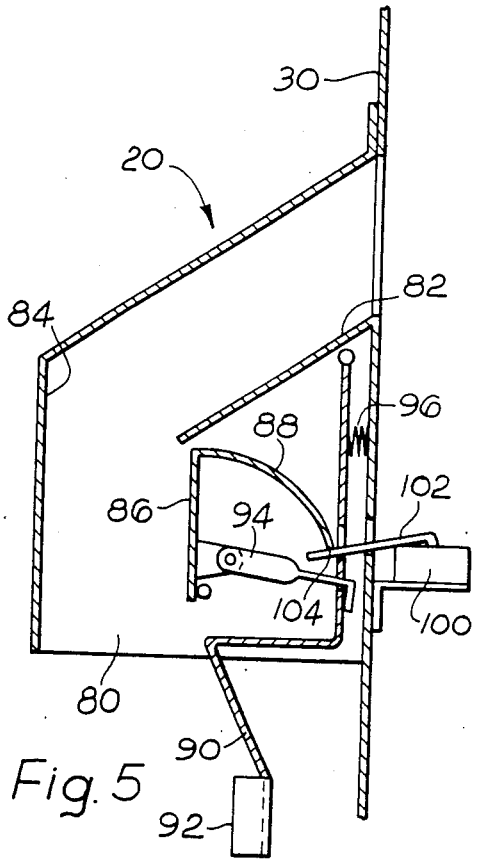
FIG. 5 is an elevational cross-sectioned side view of the structure of FIG. 4 with its door open.

The dispensing chute and control 20 has a pair of opposed sides 80, a chute floor 82 and a chute front panel 84 which form a subassembly which mounts on the front wall 30 of the dispenser. A segment shaped ice cube door 86 is pivotally mounted in the sides 80 and has an arcuate upper and outer surface 88 which normally closes the chute 20. A manual door opener 90 is pivotally mounted to the sides 80 at a level preferably above the door 86. The opener 90 has a cup receiver 92 at a level below the door 86, and a link 94 connects the opener 90 to the door 86. The link 94 is concealed within the door 86 and opener 90 as best seen in FIG. 4. A spring 96 biases the opener 90 and cup receiver 92 forward and also biases the door 86 closed through the link 94. An ice dispensing actuator switch 100 is provided to turn on the motor/gearbox 46 and cause rotation of the agitator 14 and feeder 18. The switch 100 is mounted within the cabinet 12 and has a forward extending actuator 102 which extends through the opener 90. The door 86 has a leading arcuate edge 104 on its arcuate surface 88 which engages the actuator 102 and operates the switch 100 only when the door 86 is open. The door 86 tucks under the floor 82 before the actuator 102 is engaged and before the switch 100 is actuated. The door 86 will actuate and de-actuate the switch 100 with a travel of about 0.06 inch (1.5 mm) and there is no problem of excessive tolerance. The acutation action is has been seen in the past and which extremely fast and accurate and the sloppy over dispensing that leaves cubes lying in the tray and on the floor has been eliminated. The switch 100 stays with the cabinet 12 and the dispensing chute 20 comes off as a discrete assembly for cleaning and sanitation. It is very effective, very foolproof, electrically safe, does not require a solenoid, and is cost effective.

The dispenser 10 offers the consuming public new levels of convenience, sanitation, and safety, and offers the retailer an economical and reliable apparatus to serve his consumers. The dispenser 10 is extremely effective for both ice cubes and cold beverages. The dispensing chute 20 is usable on many different types of ice cube dispensers, one example being Lents U.S. Pat. No. 4,423,830.

Although other advantages may be found and realized, and various and minor modifications suggested by those versed in the art, be it understood that I wish to embody within the scope of the patent warranted hereon, all such embodiments as reasonably and properly come within the scope of my contribution to the art.

We claim as our invention:

1. An ice cube dispensing apparatus comprising:

(a) a dispensing chute having a pair of opposed side walls, a floor, a front panel, and an outlet defined between the floor and front panel;

(b) a segment shaped outlet door having an outer surface which normally closes the outlet, said door being pivotally mounted to the side walls at a radial centerpoint of the door;

(c) a manual door opener having a pivotal mounting to the dispensing apparatus and a cup receptive abutment thereon below the door enabling the door opener to be pushed in a first direction away from the front panel and pivotally about the pivotal mounting;

(d) means connnecting the door opener to the door for opening the door when the abutment is pushed in said first direction;

(e) a spring biasing the door opener in a second direction opposite to said first direction and the door to its closed position;

(f) an ice cube dispensing switch means for operating a motor in the dispensing apparatus; and (g) means on the door for operating the switch means when the door is open.

2. The dispensing apparatus of claim 1, in which said means on the door comprises a leading edge of the outer surface of the door, said leading edge engaging and actuating the switch means when the door is open.

3. The dispensing apparatus of claim 1, in which the opener is pivotally mounted to the side walls at a level above the level of the door, and the means connecting is a link between a central portion of the opener and a backside of the door, said link being enclosed by the opener and the door.

4. The dispensing apparatus of claim 1, further comprising a cabinet for containing ice cubes, said dispensing chute being mounted to said cabinet and communicating with the interior of the cabinet, said switch means being on the cabinet and including a switch actuator extending outwardly therefrom and in the path of the door, and said chute together with said door and door opener being removable from the cabinet whereas the switch means remains on the cabinet.

5. The dispensing apparatus of claim 4, in which the switch actuator extends through a portion of the door opener.

* * * * *